US010125996B2

(12) United States Patent
Kim et al.

(10) Patent No.: US 10,125,996 B2
(45) Date of Patent: Nov. 13, 2018

(54) COOKING APPLIANCE AND BURNER DEVICE

(71) Applicant: LG Electronics Inc., Seoul (KR)

(72) Inventors: Yangho Kim, Seoul (KR); Kuyoung Son, Seoul (KR); Youngsoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 661 days.

(21) Appl. No.: 14/582,369

(22) Filed: Dec. 24, 2014

(65) Prior Publication Data

US 2015/0184863 A1 Jul. 2, 2015

(30) Foreign Application Priority Data

Dec. 26, 2013 (KR) ..... 10-2013-0163567

(51) Int. Cl.

| | |
|---|---|
| ***F24C 3/00*** | (2006.01) |
| ***F24C 3/06*** | (2006.01) |
| ***F24C 15/00*** | (2006.01) |

(52) U.S. Cl.

CPC ..... *F24C 3/008* (2013.01); *F24C 3/067* (2013.01); *F24C 15/001* (2013.01)

(58) Field of Classification Search

USPC ..... 126/39 E; 431/181

See application file for complete search history.

(56) References Cited

U.S. PATENT DOCUMENTS 3,633,562 A * 1/1972 Morse ..... F24C 3/047 126/214 R
3,698,378 A * 10/1972 Rosenberg ..... F24C 3/047 126/299 D (Continued)

FOREIGN PATENT DOCUMENTS

| | | |
|---|---|---|
| CN | 2431514 | 5/2001 |
| CN | 101737125 | 6/2010 |

(Continued)

OTHER PUBLICATIONS

Machine Translation of JP 2003-004236A, "Sobue Reference", Accessed by Examiner on Jun. 19, 2017; https://www4.j-platpat.inpit.go.jp/cgi-bin/tran_web_cgi_ejje?u=http://www4.j-platpat.inpit.go.jp/eng/translation/20170620010828890285613445384557592 3F6B1550E7DBF56F6B7FAC1DCF93106.*

(Continued)

*Primary Examiner* — Avinash Savani
*Assistant Examiner* — Martha Becton
(74) *Attorney, Agent, or Firm* — Ked & Associates LLP

(57) ABSTRACT

A cooking appliance is provided. The cooking appliance may include a case, a top plate seated on the case, and a burner accommodated in the case. The burner may include at least one burner pot to receive a gas and air, a combustion member to burn a mixed gas of the gas and air within the at least one burner pot, a burner frame seated on the at least one burner pot to define an exhaust passage, through which the gas burned by the combustion member and carbon monoxide generated by incomplete combustion of the mixed gas may flow, and a catalyst body disposed in the exhaust passage. The catalyst body may have a catalyst to allow the carbon monoxide to react with oxygen.

20 Claims, 11 Drawing Sheets

(56) References Cited

U.S. PATENT DOCUMENTS 3,799,142 A * 3/1974 Jensen ..... F23M 11/02 126/39 J
3,819,334 A * 6/1974 Yoshida ..... B01D 53/944 126/263.02
4,138,220 A * 2/1979 Davies ..... B01D 53/86 422/173
4,580,550 A * 4/1986 Kristen ..... F24C 3/067 126/39 H
4,810,185 A * 3/1989 Nakamura ..... F23D 3/18 126/96
4,927,353 A * 5/1990 Nomura ..... F23C 13/00 126/91 A
4,951,646 A * 8/1990 Diekmann ..... F24C 3/067 126/39 D
5,139,007 A * 8/1992 Bertomeu ..... F24C 3/067 126/39 D
5,251,609 A * 10/1993 Thibault ..... F23D 14/18 126/39 J
5,979,429 A * 11/1999 Schultheis ..... F24C 3/067 126/39 E
6,076,517 A * 6/2000 Kahlke ..... F23D 14/64 126/39 E
6,216,687 B1 * 4/2001 Campbell ..... F24B 1/006 126/512
6,230,701 B1 * 5/2001 Schultheis ..... F24C 3/067 126/39 B
7,690,374 B2 * 4/2010 Lee ..... F24C 15/101 126/39 J
7,878,189 B2 * 2/2011 Lee ..... F24C 3/067 126/21 A
7,895,997 B2 * 3/2011 Lee ..... F23D 14/64 126/39 E
7,942,143 B2 * 5/2011 Lee ..... F23D 14/085 126/39 E
8,065,997 B2 * 11/2011 Lee ..... F24C 3/047 126/39 H
9,383,112 B2 * 7/2016 Kwon ..... F24C 15/101
9,416,978 B2 * 8/2016 Kwon ..... F24C 3/067
2002/0164553 A1 * 11/2002 Distaso ..... F24C 3/067 431/280
2006/0048767 A1 * 3/2006 Lee ..... F24C 3/067 126/214 R
2006/0076005 A1 * 4/2006 Kim ..... F24C 3/067 126/214 R
2007/0202451 A1 * 8/2007 Lee ..... F23D 14/14 431/326
2007/0207430 A1 * 9/2007 Lee ..... F23D 14/145 431/328
2008/0008974 A1 * 1/2008 Lee ..... F23D 14/14 431/115
2009/0173333 A1 * 7/2009 Kwon ..... F24C 3/067 126/39 E
2010/0071682 A1 * 3/2010 Lee ..... F24C 3/047 126/39 E
2010/0108053 A1 * 5/2010 Lee ..... F24C 15/101 126/39 H
2011/0186035 A1 * 8/2011 Kwon ..... F24C 3/067 126/39 E
2012/0272946 A1 * 11/2012 Phillips ..... F24C 15/001 126/21 R
2015/0184864 A1 * 7/2015 Kim ..... F24C 3/067 126/39 E
2016/0178218 A1 * 6/2016 Kulemin ..... F24C 15/2007 126/21 R
2016/0374508 A1 * 12/2016 Streckfus ..... A47J 37/0611 99/325
2017/0059181 A1 * 3/2017 Froelicher ..... F24C 15/32

FOREIGN PATENT DOCUMENTS

JP 5-346213 A 12/1993
JP 06050555 A * 2/1994
JP 2001-221406 A 8/2001
JP 2003004236 A * 1/2003
JP 2005-207653 A 8/2005
KR 10-2000-0016529 3/2000
KR 10-0436954 B1 6/2004
KR 10-2011-0085150 7/2011
TW 538218 6/2003

OTHER PUBLICATIONS

Chinese Office Action dated Aug. 3, 2016 (English Translation).
Korean Notice of Allowance dated Feb. 23, 2016 issued in Application No. 10-2013-0163566.
U.S. Appl. No. 14/582,392, filed Dec. 24, 2014.
Korean Office Action dated Sep. 24, 2015.
Korean Office Action issued in Application No. 10-2013-0163567 dated Jan. 12, 2015.

* cited by examiner

COOKING APPLIANCE AND BURNER DEVICE

CROSS-REFERENCE TO RELATED APPLICATION(S)

The present application claims priority under 35 U.S.C. 119 and 35 U.S.C. 365 to Korean Patent Application No. 10-2013-0163567, filed in Korea on Dec. 26, 2013, which is hereby incorporated by reference in its entirety.

BACKGROUND

1. Field

A cooking appliance and a burner device are disclosed herein.

2. Background

Cooking appliances are apparatus that heat food or other items to cook the food or other items. Cooktops of the cooking appliances heat food or other items using heat generated by gas combustion.

Such a cooking appliance may include a case, a top plate disposed on the case, and a burner device disposed in the case. The burner device may include a burner pot, a mixing tube unit or mixing tube, a combustion member, and a nozzle unit or nozzle. A mixed gas may be burned on the combustion member.

However, in the cooking appliance according to the related art, the mixed gas may not be completely burned in the combustion member, generating carbon monoxide due to the incomplete combustion of the mixed gas.

BRIEF DESCRIPTION OF THE DRAWINGS

Embodiments will be described in detail with reference to the following drawings in which like reference numerals refer to like elements, and wherein.

DETAILED DESCRIPTION

Figure 1:
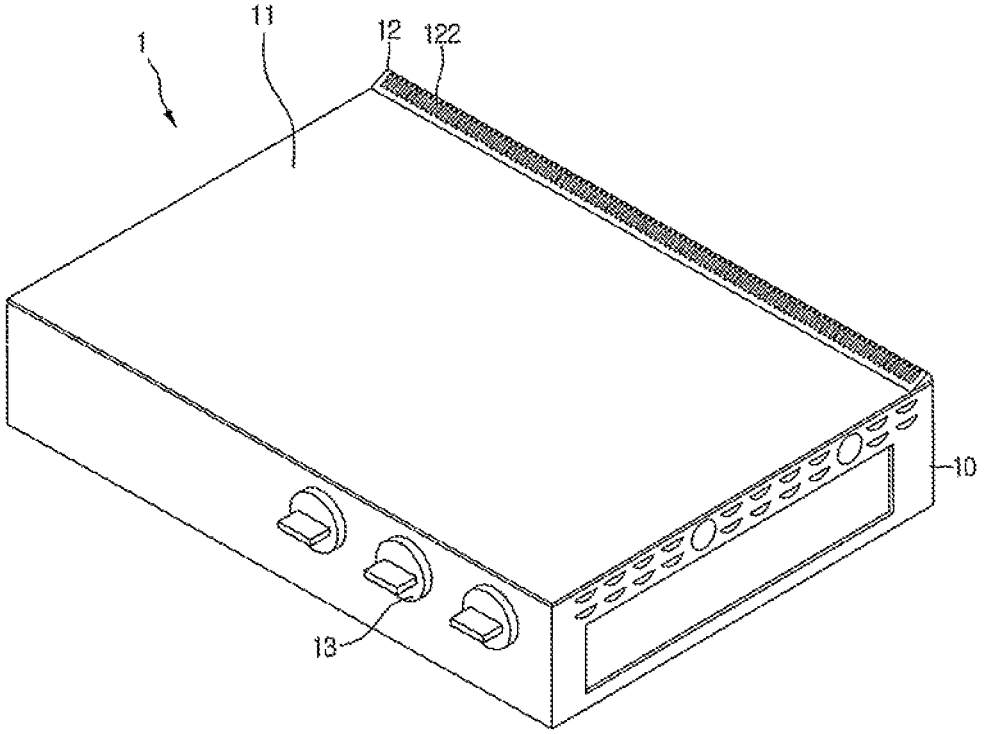
FIG. 1 is a perspective view of a cooking appliance according to an embodiment.

Reference will now be made in detail to embodiments, examples of which are illustrated in the accompanying drawings. Where possible, like reference numerals have been used to indicate like elements, and repetitive disclosure has been omitted.

In the following detailed description of embodiments, reference is made to the accompanying drawings that form a part hereof, and in which is shown by way of illustration specific embodiments in which may be practiced. These embodiments are described in sufficient detail to enable those skilled in the art to practice, and it is understood that other embodiments may be utilized and that logical structural, mechanical, electrical, and chemical changes may be made without departing from the spirit or scope. To avoid detail not necessary to enable those skilled in the art to practice, the description may omit certain information known to those skilled in the art. The following detailed description is, therefore, not to be taken in a limiting sense.

Figure 2:
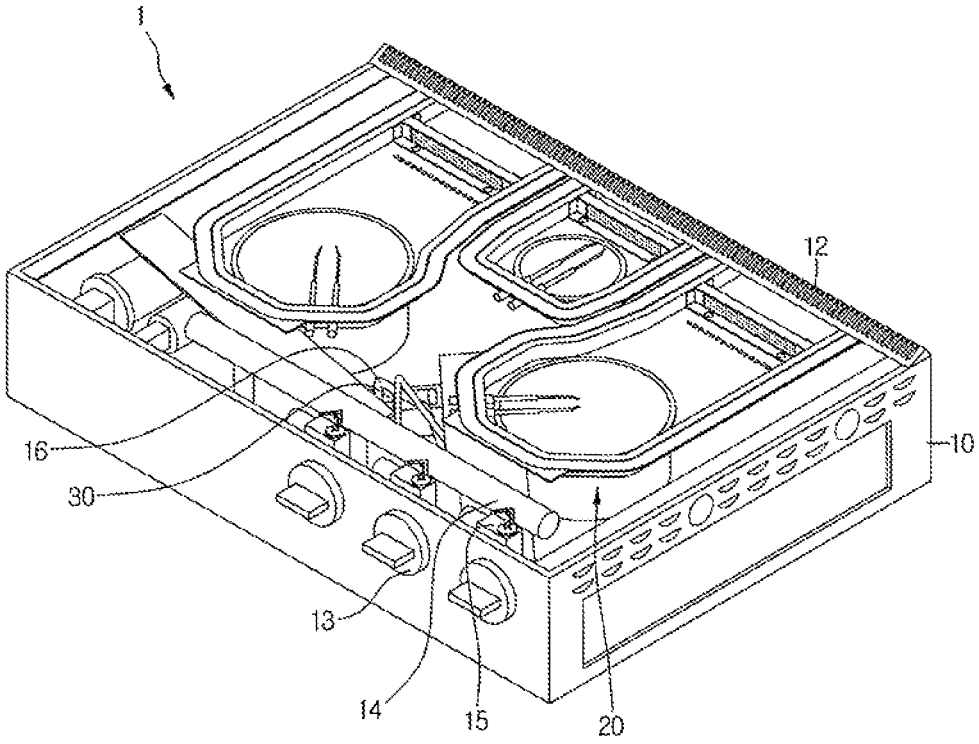
FIG. 2 is a view illustrating a state in which a top plate is removed from the cooking appliance of FIG. 1.

FIG. 1 is a perspective view of a cooking appliance according to an embodiment. FIG. 2 is a view illustrating a state in which a top plate is removed from the cooking appliance of FIG. 1.

Referring to FIGS. 1 and 2, a cooking appliance 1 according to an embodiment may include a case 10, and a top plate 11 seated on the case 10. The cooking appliance 1 may further include one or more burner device 20 accommodated in the case 10 to burn a mixed gas, in which air may be mixed with a gas, and a discharge part or discharge 12 to discharge the gas burned in the burner device 20. The discharge part 12 may be seated on an upper rear end of the case 10.

Although three burner devices 20 are disposed in the case 10 in FIG. 2, embodiments are not limited to the number of burner device 20. The discharge part 12 may include a plurality of discharge holes 122 to discharge the combustion gas.

The cooking appliance 1 may further include gas supply tubes 14 and 16, through which the gas to be supplied into the burner device 20 may flow, a gas valve 15 to adjust a flow rate of the gas supplied into the burner device 20, a nozzle device or nozzle 30 to inject the gas into the burner device 20, and a manipulation knob 13 to manipulate the gas valve 15. The manipulation knob 13 may be disposed on a front surface of the case 10. Each of the gas valve 15, the nozzle device 30, and the manipulation knob 13 may be provided in a same number as the burner device 20.

The gas supply tubes 14 and 16 may include a common supply tube 14 connected to one or a first side of the gas valve 15, and an individual supply tube 16 connected to the other or a second side of the gas valve 15 to supply the gas into the burner device 20.

Hereinafter, the burner device will be described in detail.

Figure 3:
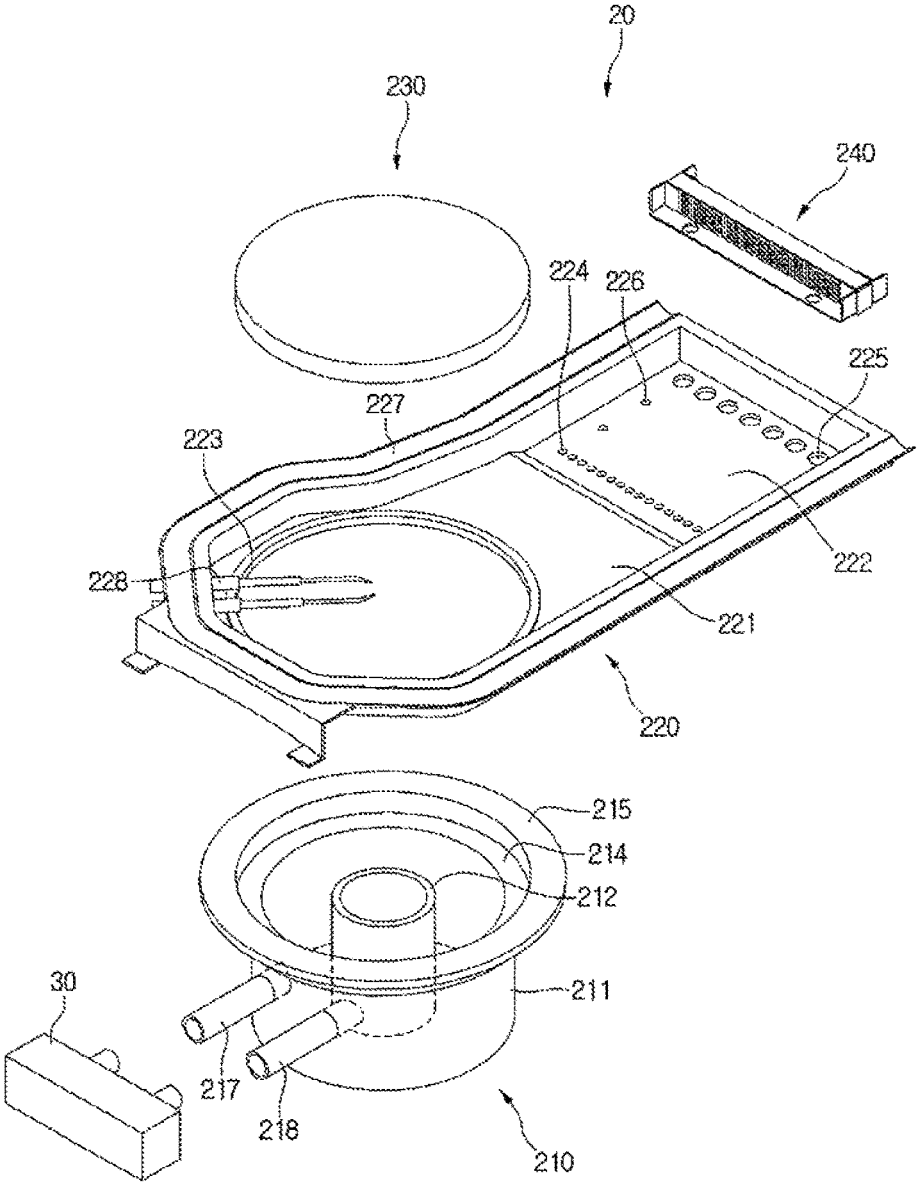
FIG. 3 is an exploded perspective view of a burner device according to an embodiment.
Figure 4:
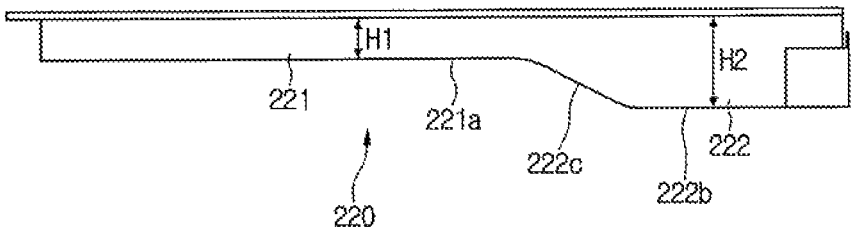
FIG. 4 is a side view of a burner frame according to an embodiment.
Figure 5:
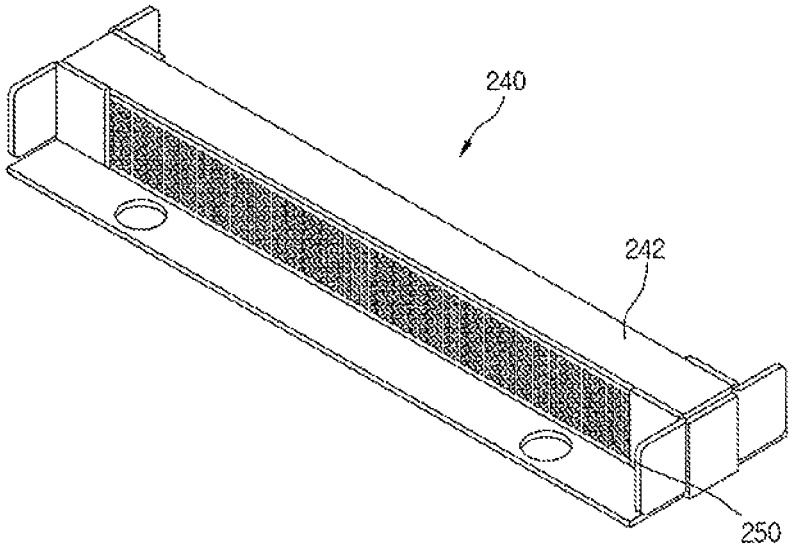
FIG. 5 is a perspective view of a catalyst device according to an embodiment.
Figure 6:
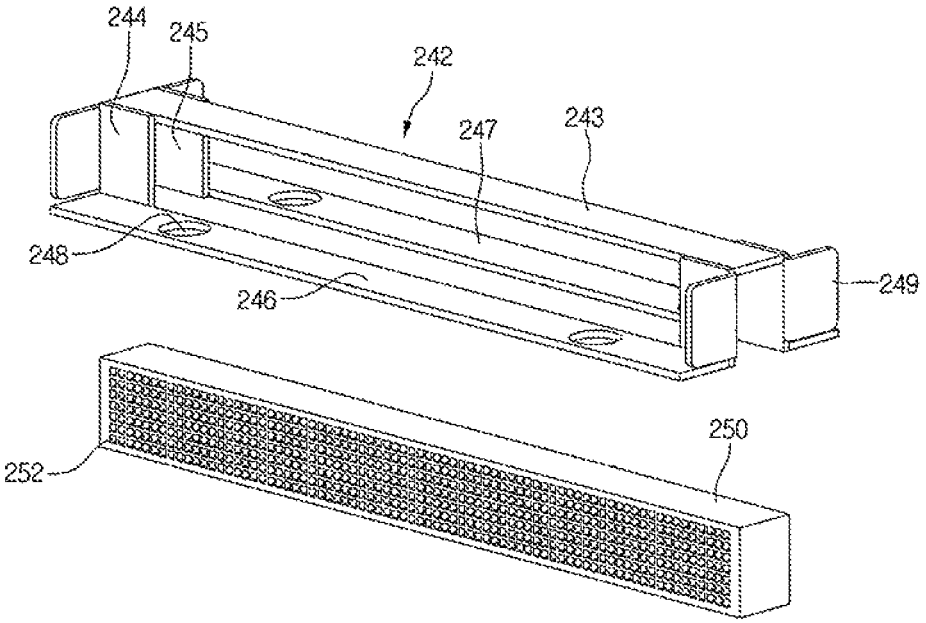
FIG. 6 is an exploded perspective view of the catalyst device of FIG. 4.

FIG. 3 is an exploded perspective view of a burner device according to an embodiment. FIG. 4 is a side view of a burner frame according to an embodiment. FIG. 5 is a perspective view of a catalyst device according to an embodiment. FIG. 6 is an exploded perspective view of the catalyst device of FIG. 4.

Referring to FIGS. 3 to 6, the burner device 20 according to an embodiment may include a burner pot 210, into which a mixed gas may be introduced, a combustion member 230 seated on the burner pot 210 and heated by heat generated by combustion of the mixed gas, a burner frame 220 seated on the burner pot 210 to provide an exhaust passage for the combustion gas burned on the combustion member 230, and a catalyst device 240 to convert carbon monoxide generated due to incomplete combustion of the mixed gas into carbon dioxide. The burner pot 210 may include a first pot 211, and a second pot 212 disposed in an inner space of the first pot 211. For example, the first pot 211 may have a cylindrical shape; however, embodiments are not limited thereto.

An inner space of the second pot 212 may be partitioned from a space between an outer surface of the second pot 212 and an inner surface of the first pot 211. Thus, the mixed gas may be supplied into the first pot 211 or the second pot 212, or may be supplied into each of the first and second pots 211 and 212 according to manipulation of the manipulation knob 13.

A first mixing tube 217 may be connected to the first pot 211, and a second mixing tube 218 may be connected to the second pot 211. For example, the second pot 212 may have a cylindrical shape; however, embodiments are not limited thereto.

Air around the mixing tubs 217 and 218 may be introduced into the mixing tubes 217 and 218 while the gas is injected from the nozzle device 30 to each of the mixing tubes 217 and 218. The gas and air may be primarily mixed with each other in the mixing tubes 217 and 218, and then, may be secondarily mixed with each other in an inner space of each of the first and second pots 211 and 212.

The second mixing tube 218 may be connected to the second pot 212 by passing through the first pot 211. Alternatively, the first mixing tube 217 and the second mixing tube 218 may be integrated with the burner pot 210.

A first seating part or seat 214, on which the combustion member 230 may be seated, may be disposed above the burner pot 210, that is, the first pot 211. When the combustion member 230 is seated on the first seating part 214, the combustion member 230 may cover the inner space of the first pot 211 and the inner space of the second pot 212 at the same time. Alternatively, the combustion member 230 may be seated on the burner frame 220. Thus, the mixed gas of the first pot 211 and the mixed gas of the second pot 212 may be burned on the combustion member 230.

Alternatively, the combustion member 230 may include a first combustion member that covers the first pot 211 and having a ring shape and a second combustion member that covers the second pot 212.

A second seating part or seat 215, on which the burner frame 220 may be seated, may be disposed above the burner pot 210, that is, the first pot 211.

The burner frame 220 may include a first frame 221 having a first height H1, and a second frame 222 having a second height H2 greater than the first height H1. The second frame 222 may be disposed at a rear side of the first frame 221 with respect to a flow of the gas. That is, the combustion gas or carbon monoxide may flow into the first frame 221 and then flow into the second frame 222.

An ignition part or ignition 228 for the combustion of the mixed gas may be disposed on the first frame 221. The ignition part 228 may be disposed above the combustion member 230. An end of the ignition part 228 may vertically overlap the second pot 212 so that the mixed gas within the second pot 212 may be ignited first.

Thus, the mixed gas passing through the combustion member 230 may be ignited by the ignition part 228, and thus, be burned to heat the combustion member 230. Thereafter, the mixed gas may be burned on the combustion member 230.

Also, in the combustion member 230, a central portion (a portion corresponding to the second pot 212) may be heated first, and then, a remaining portion (a portion corresponding to the first pot 211) may be heated. The mixed gas of the first pot 211 may be burned by heat of the remaining portion of the combustion member 230.

The first frame 221 may include a first bottom surface 221*a*, and the second frame 222 may include a second bottom surface 222*b*. The second bottom surface 222*b* may be lower than the first bottom surface 221*a*. The first bottom surface 221*a* and the second bottom surface 222*a* may be connected to each other by an inclined surface 222*c*. Thus, flow resistance when the gas of the first frame 221 flows into the second frame 222 may be minimized by the inclined surface 222*c*.

A hole 223, through which the combustion member 230 may pass, may be defined in the first frame 221. That is, when the burner frame 220 is seated on the second seating part 215 in a state in which the combustion member 230 is seated on the first seating part 214 of the burner pot 210, the combustion member 230 may pass through the hole 223.

Alternatively, the combustion member 230 may not pass through the hole 223, but rather, may contact a bottom surface of the first frame 221. In this case, the gas burned by the combustion member may pass through the hole 223.

The burner frame 220 may include a contact part or contact 227 to increase a contact area with a bottom surface of the top plate 11. The contact part 227 may extend horizontally from an upper end of the burner frame 220. As the contact part 227 may contact the bottom surface of the top plate 11, a flow of the combustion gas between the top plate 11 and the burner frame 220 may be prevented.

The catalyst device 240 may be disposed on the second frame 222 of the burner frame 220. The catalyst device 240 may include a catalyst body 250 having a plurality of holes 252, through which the combustion gas and the carbon monoxide may pass, and a fixing part or portion 242 to fix the catalyst body 250 to the burner frame 220.

To prevent the catalyst body 250 from being damaged by the heat of the combustion member 230, the catalyst device 240 may be disposed on or at a position of the burner frame 220, that is, adjacent to the discharge part 12. Thus, a distance between the catalyst body 250 and the discharge part 12 may be less than a distance between the catalyst body 250 and the combustion member 230.

Each of the plurality of holes 252 may have a circular shape, a polygonal shape, or a honeycomb shape; however, embodiments are not limited thereto. Further, the plurality of holes 252 may be horizontally defined and also vertically defined in the catalyst body 250. That is, the plurality of holes 252 may be disposed in a direction that crosses a flow direction of the gas within the second frame 222. Thus, as the catalyst body 250 has the plurality of holes 252, a contact area with the carbon monoxide may increase.

Also, to increase the contact area with the carbon monoxide, the catalyst body 250 may have a same horizontal width as the second frame 222. Further, the catalyst device 240 may have a same height as the second frame 222. Thus, the catalyst device 240 may contact the bottom surface of the top plate 11 in a state in which the catalyst device 240 is disposed on the second frame 222.

A carrier formed of a ceramic material may be coated with a catalyst to form the catalyst body 250. The carrier may be coated with the catalyst by being immersed into a container containing the catalyst or by spraying the catalyst onto the carrier, for example.

The carbon monoxide generated by the incomplete combustion of the mixed gas may react with the catalyst as the following reaction formula, and thus, be converted into carbon dioxide.

$$2CO+O_2 \rightarrow 2CO_2$$

When the catalyst device 240 is disposed on the burner frame 220, the catalyst device 240 may act as flow resistance. When the catalyst device 240 acts as the flow resistance, an amount of air introduced into the burner device 20 may be reduced, deteriorating combustion performance.

However, according to this embodiment, as the second frame 222 on which the catalyst device 240 may be disposed has a height greater than a height of the first frame 221 as described above, a second passage of the second frame 222 may have a cross-sectional area greater than a cross-sectional area of a first passage of the first frame 221. Thus, the flow resistance due to the catalyst device 250 may be minimized to allow the air to be stably introduced into the burner device 20.

The longer a time period for which the carbon monoxide contacts the catalyst body 250, the more an amount of carbon monoxide discharged from the cooking appliance may decrease.

According to this embodiment, as the second frame 222 on which the catalyst device 240 may be disposed has a height greater than a height of the first frame 222, a flow rate of the gas within the first frame 221 may be less than a flow rate of the gas within the second frame 222. Thus, as the flow rate of the carbon monoxide in the second frame 222 is reduced, a flow rate of the carbon monoxide passing through the plurality of holes 252 of the catalyst body 250 may be reduced to increase a contact time between the catalyst and the carbon monoxide. Thus, an amount of carbon monoxide discharged outside of the cooking appliance 1 may be minimized.

To allow the carbon monoxide to react with oxygen using the catalyst, oxygen within the burner frame 220 may be sufficiently secured.

Thus, in this embodiment, at least one first inflow hole 224, through which air containing oxygen may be introduced, may be defined in the second bottom surface 222*b* of the second frame 222 to supply the oxygen into the burner frame 220. Alternatively, the at least one first inflow hole 224 may be defined in a side surface of the second frame 222.

As the oxygen together with the carbon monoxide has to pass through the catalyst body 250, the at least one first inflow hole 224 may be disposed at a front side of the catalyst device 240 with respect to the flow direction of the gas. Thus, the carbon monoxide together with the oxygen passing through the at least one first inflow hole 224 may pass through the plurality of holes 252 of the catalyst body 250, and the carbon monoxide may react with the oxygen in this process, and thus, be converted into carbon dioxide.

A plurality of the first inflow holes 224 may be defined in the second bottom surface 222*b* of the second frame 222 and be arranged to horizontally cross the flow direction of the gas. Thus, the oxygen may be uniformly introduced into the second frame 222.

The fixing part 242 may include an upper body 243 seated on a top surface of the catalyst body 250, and first and second extension parts or extensions 244 and 245 that, respectively, extend downward from both ends of the upper body 243. Each of the first and second extension parts 244 and 245 may be vertically bent from the upper body 243. The first and second extension parts 244 and 245 may be disposed to be spaced apart from each other in a direction parallel to the flow direction of the gas within the burner frame 220. The upper body 243 may contact a bottom surface of the top plate 11.

The fixing part 242 may further include first and second lower bodies 246 and 247 that, respectively, extend horizontally from the first and second extension parts 244 and 245. Alternatively, the lower body may extend from one of the first and second extension parts 244 and 245. Each of the lower bodies 246 and 247 may be seated on the second bottom surface 222*b* of the second frame 220.

At least one coupling hole 248, to which a coupling member (not shown) may be coupled, may be defined in each of the lower bodies 246 and 247. At least one coupling hole 226, to which the coupling member may be coupled, may be defined in the second bottom surface 222*b* of the second frame 222.

The catalyst body 250 may be inserted between the first and second extension parts 244 and 245. Thus, when the lower bodies 246 and 247 are coupled to the second frame 222 by the coupling member, vertical movement of the catalyst body 250 may be prevented by the upper body 243. Also, horizontal movement of the catalyst body 250 may be prevented by the first and second extension parts 244 and 245. That is, each of the first and second extension parts 244 and 245 may function as a movement prevention part to prevent the catalyst body 250 from moving in a direction parallel to the flow direction of the gas within the second frame 222.

A front/rear direction may represent a direction parallel to the flow direction of the gas within the burner frame 220, and a left/right or lateral direction may represent a direction that horizontally crosses the flow direction of the gas.

The fixing part 242 may further include a contact part or contact 249 vertically bent from at least one of the first and second extension parts 244 and 245 to contact a side surface of the second frame 222. The contact part 249 may be bent from the at least one of the first and second extension parts 244 and 245 to improve a strength of the fixing part 242. The contact part 249 may contact the second frame 222 to prevent the carbon monoxide from flowing between the second frame 222 and the fixing part 242.

Figure 7:
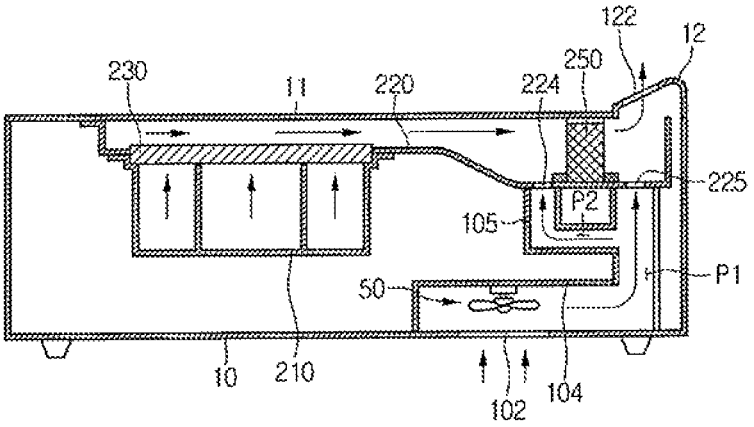
FIG. 7 is a vertical cross-sectional view of the cooking appliance of FIG. 1.

FIG. 7 is a vertical cross-sectional view of the cooking appliance of FIG. 1. Referring to FIG. 7, a fan 50 for an air flow may be disposed in the case 10. An air inflow hole 102, through which external air may be introduced, may be defined in a bottom or side surface of the case 10.

Flow guides 104 and 105 to guide air introduced through the air inflow hole 102 to the burner frame 220 may be disposed within the case 10. The flow guides 104 and 105 may include a first flow guide 104 that defines a first passage P, and a second flow guide 105 that communicates with the first flow guide 104 to define a second passage P2.

At least one second inflow hole 225, through which the air may be introduced into the first passage P1, may be defined in the second bottom surface 222*b* of the second frame 222. Thus, the air of the first passage P1 may be introduced into the burner frame 220 through the at least one second inflow hole 225, and the air of the second passage P2 may be introduced into the burner frame 220 through the at least one first inflow hole 224.

The at least one second inflow hole 225 may be defined at a rear side of the catalyst device 240 with respect to the flow of the gas within the burner frame 220. Thus, the catalyst device 240 may be disposed on the second frame 222 between the first and second inflow holes 224 and 225.

As an exhaust gas flowing into the burner frame 220 has a high temperature, when the high-temperature gas is discharged outside of the cooking appliance through the discharge part 12, it may be dangerous for a user. However, according to this embodiment, as the gas passing through the catalyst device 240 may be mixed with the air introduced through the second inflow hole 225, and then, the mixed gas may be cooled and discharged outside of the cooking appliance through the discharge part 12, the danger to the user may be reduced. Also, the catalyst device 240 may be cooled by the air introduced through the second inflow hole 225.

Hereinafter, an operation of the cooking appliance according to an embodiment will be described hereinbelow.

When the manipulation knob 13 is manipulated to operate the gas valve 15, the mixed gas may be supplied into the burner pot 210. Then, the fan 50 may rotate. The mixed gas supplied into the burner pot 210 may be ignited by the ignition part 228, and thus, may be burned. Also, the combustion member 230 may be heated by heat generated by the combustion of the mixed gas.

Radiation energy of the combustion member 230 may include a frequency of at least visible light. Thus, operation of the cooling appliance may be recognized by the user through the visible light. Also, food may be heated by the combustion member 230. Alternatively, the food may be heated by conduction heat of the top plate 11.

The gas and carbon monoxide burned by the combustion member 230 may flow from the first frame 221 to the second frame 222 of the burner frame 220. The carbon monoxide flowing into the second frame 222 may be converted into carbon dioxide, while the carbon monoxide together with the oxygen passing through the first inflow hole 224 may pass through the plurality of holes 252 of the catalyst body 250.

The carbon dioxide and the combustion gas may be cooled by the air introduced through the at least one second inflow hole 225, and then, may be discharged outside through the plurality of discharge holes 122 of the discharge part 12.

Figure 8:
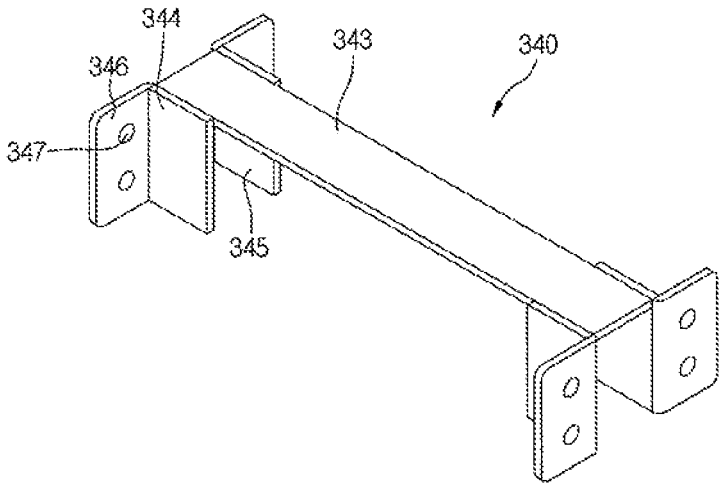
FIG. 8 is a perspective view of a fixing device according to another embodiment.

FIG. 8 is a perspective view of a fixing part or device according to another embodiment. This embodiment may be the same as the previous embodiment except for a structure of a fixing part or device. Thus, only characterized parts or components of this embodiment will be principally described below, and repetitive descriptions of the same or like parts or components as that of the previous embodiment have been omitted.

Referring to FIG. 8, a fixing part or device 340 according to this embodiment may include an upper body 343 seated on a top surface of catalyst body 250 and first and second extension parts or extensions 344 and 345 that respectively extend downward from both ends of the upper body 343. Each of the first and second extension parts 344 and 345 may be vertically bent from the upper body 343. Each of the first and second extension parts 344 and 345 may function as a movement prevention part or preventer to prevent the catalyst body 250 from moving in a direction parallel to a flow direction of a gas within a second frame 222. The fixing part 340 may further include a contact part or contact 346 vertically bent from each of the extension parts 344 and 345 to contact a side surface of the second frame 222.

One or more coupling hole 347, to which a coupling member may be coupled, may be defined in the contact part 346. That is, the contact part 346 may be coupled to the side surface of the second frame 222. In this case, a coupling hole (not shown), to which the coupling member may be coupled, may be defined in the side surface of the second frame 222.

Figure 9:
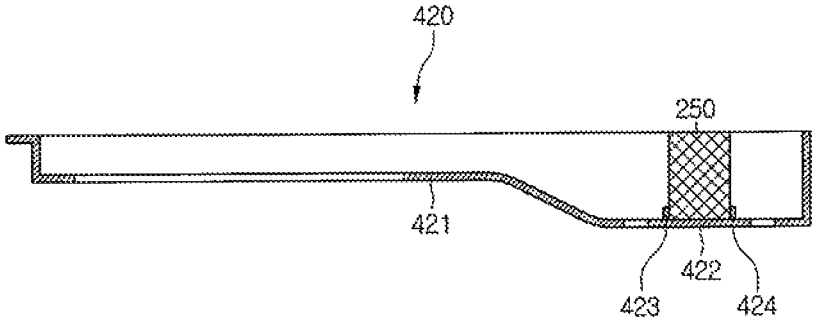
FIG. 9 is a cross-sectional view of a burner frame according to another embodiment.

FIG. 9 is a cross-sectional view of a burner frame according to another embodiment. This embodiment may be the same as the previous embodiment except for a structure of a burner frame. Thus, only characterized parts or components of this embodiment will be principally described below, and descriptions of the same or like parts or components as that of the previous embodiment have been omitted.

Referring to FIG. 9, a burner frame 420 according to this embodiment may include a first frame 421, and a second frame 422. As the first and second frames 421 and 422 have fundamental structures thereof and a height difference therebetween, which are equal to those of the first and second frames according to the previous embodiment, their detailed descriptions have been omitted.

A fixing part or device to fix a position of catalyst body 250 may be disposed on the second frame 422. The fixing part may include a plurality of ribs 423 and 424. The plurality of ribs 423 and 424 may be spaced apart from each other in a direction parallel to a flow direction of a gas within the burner frame 420.

The plurality of ribs 423 and 424 may include a first rib 423 that contacts a front surface of the catalyst body 250, and a second rib 424 that contacts a rear surface of the catalyst body 250. A distance between the first and second ribs 423 and 424 may be equal to a front to rear width of the catalyst body 250. Thus, the catalyst body 250 may be inserted between the first and second ribs 423 and 424 and be seated on the second frame 222.

The catalyst body 250 may contact a bottom surface of top plate 11. Thus, vertical movement of the catalyst body 250 may be prevented.

That is, according to this embodiment, the catalyst body 250 may be fixed to the burner frame 420 through a simple structure. Each of the plurality of ribs 423 and 424 may function as a movement prevention part or preventer that prevents the catalyst body 250 from moving in a direction parallel to the flow direction of the gas within a second frame 222.

Figure 10:
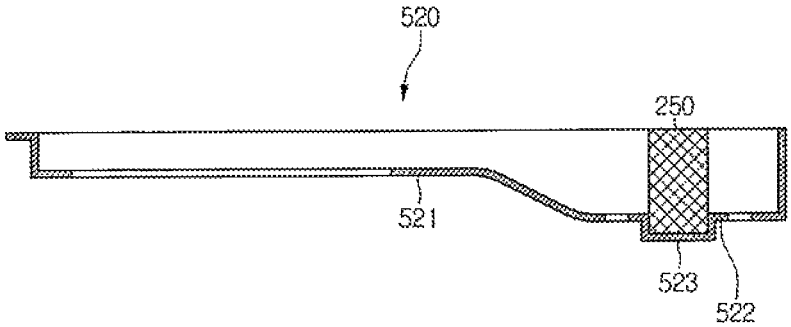
FIG. 10 is a cross-sectional view of a burner frame according to still another embodiment.

FIG. 10 is a cross-sectional view of a burner frame according to another embodiment. This embodiment may be the same as the previous embodiment except for a structure of a burner frame. Thus, only characterized parts or components of this embodiment will be principally described below, and repetitive descriptions of the same parts or components as that of the previous embodiment have been omitted.

Referring to FIG. 10, a burner frame 520 according to this embodiment may include a first frame 521, and a second frame 522. As the first and second frames 521 and 522 have fundamental structures thereof and a height difference therebetween, which are equal to those of the first and second frames according to the previous embodiment, their detailed descriptions have been omitted.

A fixing part or device to fix a catalyst body 250 to the second frame 522 may be disposed on the second frame 522. The fixing part may include an accommodation groove 523 that accommodates the catalyst body 250. A bottom surface of the second frame 522 may be recessed downward to form the accommodation groove 523.

The catalyst body 250 may contact a bottom surface of top plate 11 in a state in which the catalyst body 250 is accommodated in the accommodation groove 523. Thus, vertical movement of the catalyst body 250 may be prevented.

Thus, according to this embodiment, the catalyst body 250 may be fixed to the burner frame 520 through a simple structure. Each of the plurality of accommodation grooves 523 may function as a movement prevention part or preventer to prevent the catalyst body 250 from moving in a direction parallel to the flow direction of the gas within a second frame 222.

Figure 11:
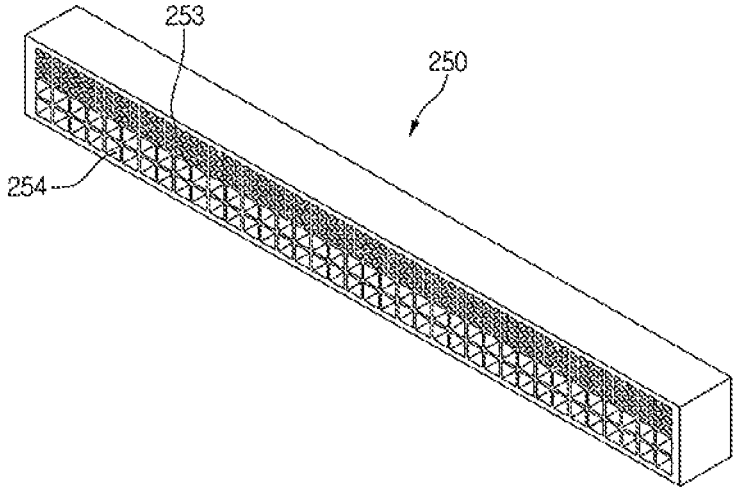
FIG. 11 is a perspective view of a catalyst body according to another embodiment.

FIG. 11 is a perspective view of a catalyst body according to another embodiment. This embodiment may be the same as the previous embodiment except for a structure of a catalyst body. Thus, only characterized parts or components of this embodiment will be principally described below, and descriptions of the same or like parts or components as that of the previous embodiment have been omitted.

Referring to FIG. 11, a catalyst body 250 according to this embodiment may include a plurality of holes 253, each of which may have a first size, and a plurality of second holes 254, each of which may have a second size greater than the first size. The plurality of second holes 254 may be defined in positions which are lower than positions of the plurality of first holes 253.

In a flow of a gas within the burner frame 220, a flow rate of air flowing into an upper region with respect to a passage cross-section may be faster than a flow rate of air flowing into a lower region. Thus, in the case of this embodiment, each of the first holes 253 may have a size (or diameter) less than a size or diameter of each of the second holes 254, through which carbon monoxide flowing into the lower region may pass, so that a contact time between carbon monoxide flowing into the upper region with respect to the passage cross-section and the catalyst body 250 may increase.

In this embodiment, the plurality of first holes 253 may be defined in an upper portion with respect to a position at which the catalyst body 250 is equally divided, and the plurality of second holes 254 may be defined in a lower portion. Alternatively, a hole may be defined in a side surface of the second frame 222, and the catalyst body may pass through the hole and then be inserted into the second frame.

Embodiments disclosed herein provide a cooking appliance capable of minimizing discharge of carbon monoxide due to incomplete combustion and a burner device or burner.

Embodiments disclosed herein provide a cooking appliance that may include a case; a top plate seated on the case; and a burner device or burner accommodated in the case. The burner device may include a burner pot to receive a gas and air; a combustion member to burn a mixed gas of the gas and air within the burner pot; a burner frame seated on the burner pot to define an exhaust passage, through which the gas burned by the combustion member and carbon monoxide generated by incomplete combustion of the mixed gas may flow; and a catalyst body disposed in the exhaust passage. The catalyst body may have a catalyst to allow the carbon monoxide to react with oxygen.

Embodiments disclosed herein further provide a burner device or burner that may include a burner pot to receive a gas and air, a combustion member to burn a mixed gas of the gas and air within the burner pot; a burner frame seated on the burner pot to define an exhaust passage, through which the gas burned by the combustion member and carbon monoxide generated by incomplete combustion of the mixed gas may flow; a catalyst body disposed in the exhaust passage, the catalyst body having a catalyst to allow the carbon monoxide to react with oxygen; and a fixing part or device to fix a position of the catalyst body. The catalyst body may have a plurality of holes through which the carbon monoxide may pass.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance, comprising:

a case;

a top plate seated on the case; and at least one burner accommodated in the case, wherein the at least one burner comprises:

at least one burner pot to receive a gas and air;

a combustion member to burn a mixed gas of the gas and air within the at least one burner pot;

a burner frame seated on the at least one burner pot to define an exhaust passage, through which the gas burned by the combustion member and carbon monoxide generated by incomplete combustion of the mixed gas flows; and a catalyst body disposed in the exhaust passage, the catalyst body having a catalyst that allows the carbon monoxide to react with oxygen, wherein the burner frame comprises a first frame seated on the at least one burner pot, a second frame that extends from the first frame and on which the catalyst body is mounted, and an inclined surface that connects a first bottom surface of the first frame with a second bottom surface of the second frame, wherein a contact part of each of the first and second frames is in contact with a bottom surface of the top plate to further define the exhaust passage, wherein the first frame has a first height, and the second frame has a second height greater than the first height, and wherein the second bottom surface of the second frame is disposed lower than the first bottom surface of the first frame.

2. The cooking appliance according to claim 1, wherein the catalyst body includes a carrier and a catalyst applied to the carrier.

3. The cooking appliance according to claim 2, wherein the carrier is formed of a ceramic material.

4. The cooking appliance according to claim 1, wherein the catalyst body comprises a plurality of holes, through which the carbon monoxide passes.

5. The cooking appliance according to claim 4, wherein the plurality of holes are horizontally and vertically defined in the catalyst body.

6. The cooking appliance according to claim 4, wherein the plurality of holes comprises:

a plurality of first holes, each of which has a first size; and a plurality of second holes defined adjacent to the plurality of first holes and each of which has a second size greater than the first size.

7. The cooking appliance according to claim 6, wherein the plurality of second holes is disposed under the plurality of first holes.

8. The cooking appliance according to claim 1, further comprising a fixing device to fix the catalyst body to the burner frame.

9. The cooking appliance according to claim 8, wherein the fixing device comprises:

an upper body seated on an upper side of the catalyst body; and first and second extensions that extend from the upper body, the first and second extensions being spaced apart from each other in a direction parallel to a flow direction of the gas within the burner frame, and wherein the catalyst body is inserted between the first and second extensions.

10. The cooking appliance according to claim 8, wherein the fixing device comprises a plurality of ribs disposed on the burner frame and spaced apart from each other in a direction parallel to a flow direction of the gas, and wherein the catalyst body is inserted between the plurality of ribs.

11. The cooking appliance according to claim 8, wherein the fixing device comprises an accommodation groove recessed into the burner frame to accommodate the catalyst body.

12. The cooking appliance according to claim 8, wherein the catalyst body contacts a bottom surface of the top plate.

13. The cooking appliance according to claim 9, wherein the fixing device further comprises a lower body horizontally bent from at least one of the first extension or the second extension, wherein the lower body is seated on the burner frame, and wherein one or more coupling holes, through which a coupling member coupled to the burner frame passes, are defined in the lower body.

14. The cooking appliance according to claim 9, wherein the fixing device further comprises a contact bent from at least one of the first extension or the second extension to contact a surface of the burner frame, and wherein one or more coupling holes, through which a coupling member coupled to the burner frame passes, are defined in the contact.

15. The cooking appliance according to claim 9, wherein the first and second extensions, respectively, extend vertically downward from both ends of the upper body.

16. The cooking appliance according to claim 13, wherein the fixing device further comprises a contact bent from at least one of the first extension or the second extension to contact a surface of the burner frame.

17. The cooking appliance according to claim 1, wherein the at least one burner pot includes a first pot and a second pot provided in an inner space of the first pot.

18. The cooking appliance according to claim 17, wherein the first pot has a cylindrical shape.

19. The cooking appliance according to claim 1, wherein the at least one burner further includes an ignition provided on the first frame to ignite the mixed gas.

20. The cooking appliance according to claim 1, wherein the first frame, the inclined surface, and the second frame are integrally formed with each other.

* * * * *